US005819848A

United States Patent [19]

Rasmuson et al.

[11] Patent Number: 5,819,848

[45] Date of Patent: Oct. 13, 1998

[54] FLOW RESPONSIVE TIME DELAY PUMP MOTOR CUT-OFF LOGIC

[75] Inventors: Gordon L. Rasmuson, Abilene; Paul Pigue, Richmond, both of Tex.

[73] Assignee: Pro Cav Technology, L.L.C., Richmond, Tex.

[21] Appl. No.: 696,632

[22] Filed: Aug. 14, 1996

[51] Int. Cl.[6] ..... E21B 47/00

[52] U.S. Cl. ..... 166/250.15; 166/53; 417/43

[58] Field of Search ..... 166/250.15, 53, 166/369; 417/43

[56] References Cited

U.S. PATENT DOCUMENTS

| | | | |
|---|---|---|---|
| 4,509,901 | 4/1985 | McTamaney et al. | 166/250.15 X |
| 4,767,280 | 8/1988 | Markuson et al. | 166/53 X |
| 4,874,294 | 10/1989 | Karg | 417/43 X |
| 5,222,867 | 6/1993 | Walker, Sr. et al. | 417/43 X |
| 5,295,790 | 3/1994 | Bossart et al. | 417/43 |
| 5,314,016 | 5/1994 | Dunham | 166/250.15 |
| 5,654,504 | 8/1997 | Smith et al. | 417/43 X |

*Primary Examiner*—William P. Neuder
*Attorney, Agent, or Firm*—Bush, Riddle, & Jackson L.L.P.

[57] ABSTRACT

An automatically controlled fluid flow responsive method for achieving de-energization of an electric motor operatively connected with a downhole pump being connected to a production tubing string of a well when flow from the downhole pump becomes abnormally low. A selective electronic cut-off signal is programmed, representing a selected minimum acceptable rate of discharge flow from the downhole pump. A flow transducer provides an electronic flow related signal to the control circuitry, representing actual pump discharge flow. The control circuitry is also programmed with a selected electronically controlled time delay period which is initiated when the flow related signal becomes less than the selective cut-off signal. When the flow related signal remains less than the cut-off signal for the duration of the time delay period the control circuitry interrupts the electrical power supply to the pump motor. The time delay motor cut-off control logic is provided with an adjustable "set flow" logic and an adjustable "cut-off delay" logic which establish parameters of allowable minimum pump discharge flow and the time period that the pump will be allowed to operate below a preset minimum allowable flow rate. A flow transducer is provided to monitor the pump discharge and continuously provides flow related signals which are received by the control logic. When the preset "minimum flow" and "time period" settings are met the control logic will provide a control signal to de-energize the electrical power circuit of the pump motor, thus shutting down the pump or to shift the pump to a lower operating speed. The pump motor cut-off logic incorporates a start-up delay which maintains the pump cut-off logic in a deactivated state for a period of time which is selected to permit the well production system to reach its operational characteristics.

15 Claims, 4 Drawing Sheets

FLOW RESPONSIVE TIME DELAY PUMP MOTOR CUT-OFF LOGIC

BACKGROUND OF THE INVENTION

1. Field of the Invention

This invention relates generally to pumps that are located downhole within wells for pumping well fluid, typically petroleum products and water, which enter the wells from oil bearing subsurface formations. This invention also concerns an electronic protective system for deenergizing the rotary motor operated drive system of a downhole pump in the event that an abnormally low pump discharge flow exists, which might indicate pump wear, damage or any other pump or pump motor abnormality. More specifically, the present invention concerns a time delay motor cut-off circuit which can cause pump shut down by deenergizing the pump motor in the event abnormally low pump discharge flow is sensed by a flow transducer that continuously measures pump discharge flow at a location immediately adjacent the pump and transmits electrical signals representing pump flow. More particularly, the present invention is directed to a time delay motor cut-off logic that is responsive to a low flow condition for shutting down a downhole pump and motor assembly and yet permits pump operation for a predetermined period of time under a condition of abnormally low flow to prevent pump shut-down and thus loss of pump productivity under circumstances where the pump driven by the motor is subject to fluctuations in discharge flow because of variations in the gas content of the fluid passing through the pump or because of the existence of other well anomalies of short duration.

2. Description of the Prior Art

Although the present invention is discussed herein particularly as it relates to progressive cavity pumps for production of well fluids from wells, particularly oil wells, it should be borne in mind that this invention is also applicable to other rotary well pumps, such as electrically energized submersible pumps, for example. Thus, the terms "well pump", "downhole pump", etc. are intended to encompass various types of rotary surface and subsurface pumps that may be used for motorized production of liquid petroleum products and associated liquids from wells.

In cases where crude oil production wells are to be pumped, it has been the practice of late to install a production tubing string within a well, with a progressive cavity fluid lift pump being located in the downhole environment at or near the lower end of the production tubing string and below the standing fluid level of the well, a level or depth that is typically above the subsurface zone being produced. A rotary drive mechanism, powered by a rotary electric motor is typically mounted to the well head and drives a sucker rod string which in turn drives the progressive cavity pump.

It is well known that the potential flow conditions of oil wells tend to fluctuate significantly and sometimes rapidly due to the presence of gas within the crude oil flowing from the formation. Thus, well pumps that are located in the downhole environment are often subject to temporary low liquid discharge resulting from the presence of gas that migrates to the well along with the well fluid. Under such conditions the pump will ordinarily be restored to its proper rate of liquid discharge as soon as the excess gas condition is dissipated (typically only a few seconds at a time).

Conditions of low liquid discharge of the pump can also occur for reasons that have little to do with the production characteristics of the subsurface formation or the presence of gas in the well fluid. In some cases, because of the contaminated or abrasive characteristics of the well fluid being pumped, including the volume of entrained solids therein, the pump can become worn so that its liquid discharge capability is minimized. When pump wear becomes excessive the pump motor will typically maintain its rate of rotation, but the discharge flow from the pump will be impaired. In this circumstance it will be appropriate to retrieve the production tubing and the pump from the well for pump repair or replacement. In the event the pump should become subject to excessive load, due to fouling by solid components of the well fluid or due to the presence of deposits in the pump from the well fluid, the pump motor will be stalled or slowed by the excess load. In this case, before the pump motor should become overheated by the load to the point that it should fail, it is desirable to sense this overload condition evidenced by low flow and shut down the pump so that it can be recovered from the well and repaired. Pump and motor overload and damage can occur as the result of being subjected to excessive forces which will stall or slow the pump down and cause overheating of the motor. Motor failure can occur in a short period of time under these circumstances. It is desirable therefore to provide a protective system for the pump and its motor which will automatically shut down the pump at any time that its operation is indicative of abnormalities that could damage the pump or its motor if operation is continued. When conditions occur that impair the rotational capability of the pump mechanism, regardless of the cause thereof, diminished pump discharge flow will occur. Thus, according to the present invention it is desirable to continuously sense pump discharge flow and to deenergize the pump or controllably slow pump operation in the event pump discharge flow rate should fall below a predetermined set point for any of a number of reasons. It is desirable that the pump system have the capability of accommodating inherent fluctuations in flow measurement without permanently shutting down the pumping operation in response to a flow measurement anomaly that is only temporary.

Most electrically energized downhole pump systems are provided with pump control circuitry that is typically located at the surface. This control circuitry can incorporate protective circuitry that is responsive to pump load, typically measured by an ammeter, or responsive to the thermal conditions of the pump motor. Typically, however, when abnormal conditions are sensed, the protective circuitry will achieve instant and permanent automatic pump shut down by deenergizing the pump motor. The pump system will then remain de-energized until service personnel conduct appropriate tests. If automatic pump shut down should occur as the result of a temporary well condition or pump condition, then production from the well will perhaps be terminated improperly and valuable production from the well can be lost. It is desirable therefore to provide a flow responsive pump cut-off system that effectively overcomes this problem. The pump cut-off system of the present invention ensures that the well is shut-in under circumstances where the pump or its motor could become irreparably damaged if pumping should continue, but also insures that the well is not shut-in under circumstances where temporary anomalies, such as temporary pump discharge flow occurs and quickly passes.

When pump start or restart occurs it is necessary to disable low flow responsive pump cut-off logic to provide for filling of the production tubing and for pump discharge flow to exist within the flow sensitive transducer. Thus the pump cut-off control system of the present invention is provided with a startup delay period that can be adjusted according to various well parameters such as standing fluid depth, tubing size, ect. to provide a field selectable time delay period which must expire after start-up before the pump cut off logic circuitry is activated Typically, when pump shut down is caused by conventional pump control equipment, the pump remains out of service until such time as well servicing personnel can inspect the well and place the pump back on line. Since many wells are located in remote areas and are seldom visited by well service personnel, a deactivated downhole pump can remain deactivated for long periods of time thereby causing the production of the well during that period of time to be lost. This is of course an undesirable condition which finds its solution in the present invention.

In accordance with the present invention, for detection of pump discharge flow conditions, a flow responsive transducer is located in the flow line, preferably in the discharge line from the well and continuously transmits a flow related electronic signal in the nature of a voltage, a current, a frequency, etc., via electronic control conductors to electronic control equipment that is located at the surface. These flow related electrical signals can be generated by any suitable flow transducer, such as an orifice type flow meter, a turbine type flow meter, a differential pressure sensor and the like. In the event abnormally low pump discharge flow condition is detected that could cause damage to the pump or to the pump motor assembly, the control system at the surface will deactivate the power circuit of the pump motor thereby causing the pump to shut down.

SUMMARY OF THE INVENTION

It is a principal feature of the present invention to provide a novel flow rate responsive time delay logic for an electric motor which permits motor operation of predetermined duration following detection of an abnormal flow rate condition under circumstances where the abnormal flow rate condition does not continue beyond the predetermined period of time.

It is also a feature of this invention to provide a novel time delay pump motor cut-off logic that is responsive to the output voltage signals of a suitable flow responsive transducer, such as a differential pressure transmitter or a turbine meter for example, which detects the pump discharge fluid flow conditions and which accomplishes shutdown of the motor drive of a downhole pump under circumstances where abnormally low pump discharge flow conditions are indicated beyond a predetermined maximum period of time.

It also a feature of the present invention to provide a novel downhole pump system having an automatic time delay motor cut-off circuit that is adjustable for a wide range of delay time by field personnel according to the flow parameters of the well and can be easily adjusted in the field to accommodate circumstances where well flow parameters change after initial installation of the equipment.

It an even further feature of the present invention to provide a novel time delayed motor cut-off logic for a downhole pump system and wherein the electronic circuitry of the logic incorporates a start-up timer that sets the time interval for activation of the motor cut-off logic and thus permits the pump system to become stabilized before the cut-off delay circuit becomes operational.

It also a feature of the present invention to provide a novel downhole pump system having an automatic time delay motor cut-off logic that provides a digital readout of the flow condition of the pump and which incorporates a set level switch that can be manually positioned to indicate the set level position of the time delay circuitry, thus enabling field personnel to quickly determine the parameters for which the circuitry has been set.

It is also a feature of the present invention to provide an electronic logic system for downhole rotary pumps which accomplishes pump shut down responsive to the existence of an abnormally low pump discharge flow that has a duration exceeding a selected time period for which the electronic logic system is set.

BRIEF DESCRIPTION OF THE DRAWINGS

The various objects and advantages of this invention will become apparent to those skilled in the art upon an understanding of the following detailed description of the invention, considered in light of the accompanying drawings which are made a part of this specification and in which.

DETAILED DESCRIPTION OF PREFERRED EMBODIMENT

Figure 1:
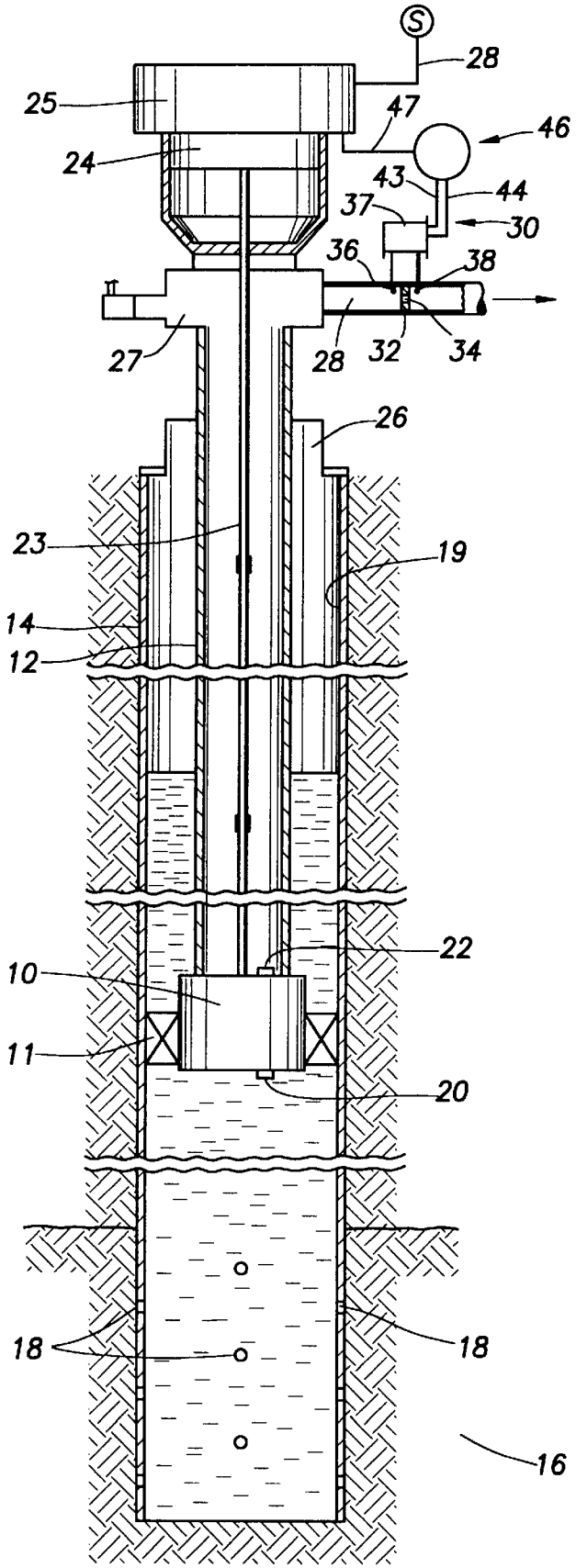
FIG. 1 is a diagrammatic illustration of a progressive cavity well pumping system according to the present invention, having an electric motor energized downhole pump driven by a rotary sucker rod string for pumping well fluid from the well bore through a production tubing string and across a differential pressure orifice meter that is adapted to generate electronic signals responsive to pump discharge fluid flow and transmit flow responsive signals to a control logic for use in motor control.

Referring now to the drawings and first to FIG. 1, a progressive cavity type rotary pump shown generally at 10 is secured by an anchor 11 at a desired depth within a production tubing string 12 that is located within a well casing 14 intersecting a subsurface production zone 16 containing liquid petroleum products to be produced. The liquid petroleum products, typically crude oil and typically accompanied by water migrate from the subsurface formation and enter the well casing that lines the well bore 19 via perforations 18 in the well casing and typically rise within the casing to a standing level well above the depth of the producing formation. The standing level of the well is determined by the character of the producing formation. The pump is located within the casing below the standing level of the well fluid and above the producing zone. Its location depth within the casing is determined by the producing characteristics of the subsurface formation and various other parameters of the well and the pumping equipment. The progressive cavity pump defines a fluid inlet 20 in communication with the liquid standing within the casing and has a fluid discharge 22 which is open to the production tubing string 12. The pump 10 is energized by a rotary sucker rod string 23 which extends through the production tubing 12 and which is driven by a rotary electric motor 24 of a drive head 25 which is mounted to the wellhead 26. The rotary electric pump motor has as its electrical supply a motor circuit having circuit 28 which receives its electrical energy from a suitable source "S" of electrical power supplying the electrical requirements of the oil field being produced.

The production tubing of the well is in communication with a flow coupling 27 having a flow line 28 connected thereto and arranged for delivery of petroleum products to sales. Adjacent to or mounted to the flow line 28 is provided a flow transducer shown generally at 30 and having an electrical signal output representing the rate of flow through the flow line with the electrical signals thus evidencing the condition of pump discharge flow at any point in time. Any, of several types of flow transducers, such as orifice meters, turbine meters and differential pressure meters may be employed for this purpose. As an example, FIG. 1 illustrates an orifice meter type flow transducer 30 being used to measure discharge flow of the pump flowing through the flow line 28 and having an internal orifice plate 32 defining a centrally located orifice bore 34 through which the well fluid is caused to flow by the discharge of the downhole pump 10. The flow meter will preferably be of the flanged union type and its orifice bore will be custom sized to best suit individual field application for the expected flow rate, size of production tubing, etc. Since the orifice 34 represents a restriction in the discharge flow path from the pump, fluid pressure immediately upstream and immediately downstream of the orifice will be different, with upstream pressure being the higher of the two. A differential pressure transducer 37, sensing the pressure differential between opposite sides 36 and 38 of the orifice 34, as a result of the fluid flowing through the orifice and for generating an electronic flow responsive electrical signal in the form of a voltage or electrical current. This electrical signal is conducted via a signal conductor 44 and 46 to a control console 46, to be discussed in detail hereinbelow, and which is typically located adjacent the well being produced or mounted to the wellhead equipment in a position for visual inspection by well service personnel. The fluid flow related electrical signal is electrically processed to provide an electrical signal output that represents the flow rate of the fluid being discharged by the pump. The flow meter 30 or differential pressure meter, as the case may be, can be powered by a 24 volt power supply if needed or may be powered by any other suitable power source from the control consol 46 via an appropriate power conductor 47. During normal operation of the downhole pump 10 a pressure drop will exist across the orifice, with the differential pressure being sensed representing the actual rate of fluid flow being discharged by the rotary downhole pump 10. Electrical signals representing the rate of flow within the flow line at any point in time will be supplied to the electronic logic of the control console. If the rate of fluid flow is unusually low, evidencing a pump discharge flow abnormality this abnormal condition is immediately displayed by the control console and if continuing beyond a preset period of time which is considered safe for the pump and pump drive mechanism, the logic of the control console will deenergize the pump motor so that the pump motor and pump will not be damaged.

Figure 2:
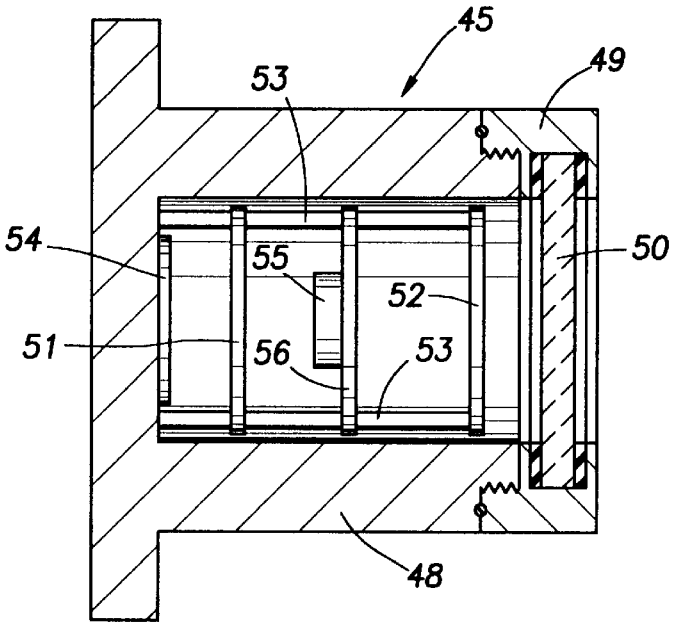
FIG. 2 is a sectional view of an explosion proof control console having therein electronic circuitry for pump motor control and further having time delay motor cut-off logic representing the preferred embodiment of the present invention, with a control circuit board being visible via an inspection window.

Referring now to FIG. 2, the control console, shown generally at 46, is provided with control circuitry which is housed within an explosion proof control console housing 48 having a removable screw thread type closure 49 which is normally sealed to the housing and is provided with an inspection window typically comprising a glass plate 50. If desired, the screw thread closure can be wire sealed, locked or otherwise secured to prevent its opening by unauthorized persons. A pair of circuit boards 51 and 52, incorporating the time delay motor cut-off logic are mounted in spaced relation within the housing by means of mounting stand-offs 53. The dual circuit board arrangement is intended as only being a representative example of the present invention. If desired, the control console may be constructed with the monitering and control logic being provided by a single circuit board or by more that two circuit boards depending upon the design characteristics that are desired.

To change any setting or re-start the time delay circuit, the housing closure must be opened to gain access to the outer circuit board 52 by opening or removing the closure 49. The control circuitry of the present invention, as shown by FIG. 2, is defined by inner and outer circuit boards, with the inner circuit board 51 having circuit connections and with the outer circuit board 52 having visible references and adjustment controls to enable users to easily set or reset the control parameters of the control circuitry. In cases where the well pump control system is to used in exceptionally cold conditions that might influence the operational characteristics of the solid state circuitry, a temperature sensor 54 may be mounted within the housing cavity in position for sensing the temperature of the housing. At a preselected low temperature an electrically energized heater 55, supported by an intermediate heat conductive mounting plate 56, will be automatically energized for ensuring that the temperature of the electronics cavity and circuit board or boards is sufficiently high that the electronic circuitry will not be impaired by extremely cold ambient temperature conditions. It should be borne in mind that control console heating systems of this nature are not of necessity unless the ambient temperature is sufficiently low that the operational characterists of the control ligic can be impaired. In most cases the control console will not be provided with a heater.

Figure 3A:
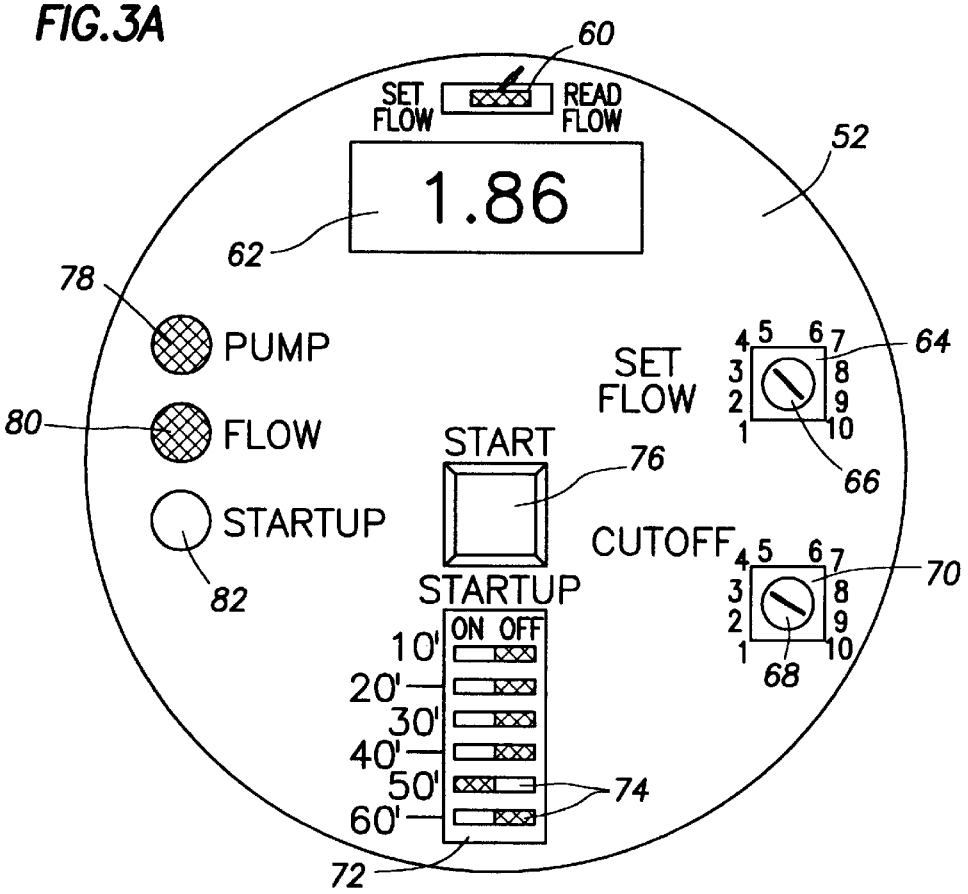
FIGS. 3A–3E are pictorial illustrations of a outer electronic circuit board for the control console of FIG. 2 and being constructed in accordance with the principles of the present invention and showing features for selective adjustment of operating parameters of the time delay motor cut-off logic, with each Fig. representing differing operational aspects of the circuitry and representing operational parameters of the downhole pump.
Figure 3B:
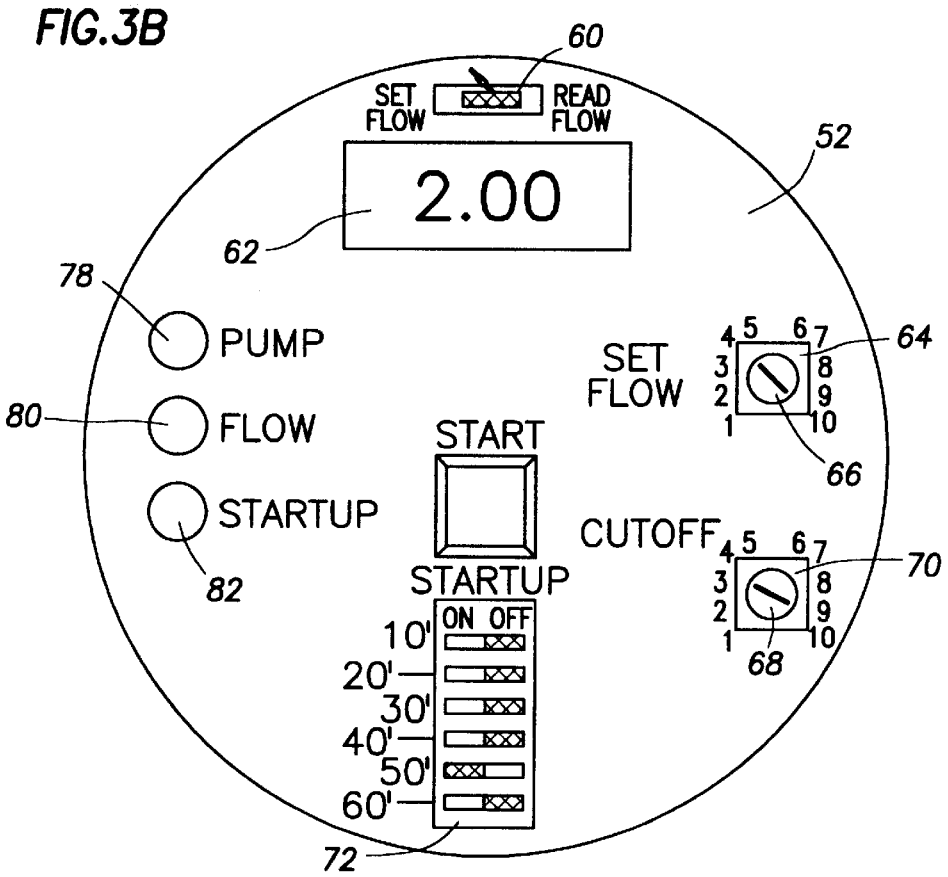

Referring now to FIGS. 3A–3E, the outer circuit board 52 is visible to service personnel and provides a visual display of the operational characteristics of the downhole pump. The outer circuit board is provided with a "set flow/read flow" switch 60 that is a momentary toggle switch which is spring urged to the "read flow" position as shown in FIG. 3A. This switch is located adjacent a light emitting diode (LED) or liquid crystal display panel 62 having a digital voltmeter display that is visible to service personnel and provides a visual display of the conditions of discharge flow of the downhole pump. In the "read flow" position of the momentary toggle switch the actual output voltage of the flow meter is displayed, for example 1.86 volts as shown in FIG. 3A, which represents an instantaneous volume of flow through the flow meter. When the momentary toggle switch 60 is moved to the "set flow" position as shown in FIG. 3B the digital voltmeter of the display panel 62 will indicate the preselected threshold voltage of the flow meter for pump cut-off.

The outer circuit board 52 is provided with a "set flow" potentiometer 64 having an adjustment element 66 and showing graduated voltage increments from 1 to 10, which are used by the operator as "setting" references. The actual voltage range is from 1 to 5 volts for the circuitry that is shown, but may be provided in any voltage range that is suitable for the intended purpose. The "set flow" potentiometer adjusts the set point for the desired flow rate below which, if the flow remains for longer than a selected period of time, typically measured in seconds, the pump motor is to be de-energized by control circuit activation of its cut-off switch. To adjust the flow cutoff set point, the momentary toggle switch is held at its "set flow" position as shown in FIG. 3B while the "set flow" potentiometer is adjusted manually by rotating it to the desired voltage setting as indicated by the potentiometer reference marks and as confirmed by the digital voltmeter display panel 62.

The outer circuit board 52 is also provided with a cut-off delay adjustment in the form of a cut-off delay potentiometer 68 having a potentiometer adjustment element 70 that is adapted for manual rotation. Surrounding the potentiometer 68 are spaced indicia 1–10 which are reference indicia typically indicating a selected cut-off delay in terms of seconds or other preselected range. The delay time can be adjusted between one second and to a maximum of about 10 seconds. The cut-off potentiometer is adjusted manually by turning the center slot of the potentiometer adjust element 70, such as with a small screwdriver. During actual operation when the flow rate drops below the pre-selective cut-off rate and remains below that flow rate for a period of time equal to or greater than the delay period that is defined by the cut-off delay potentiometer, the motor cut-off switch of the downhole pump motor will be activated. When this occurs, the motor cut-off switch will disconnect the power switch of the motor. The desired cut-off delay is dependent on the amount of gas in the flow through the downhole flow meter and should be adjusted accordingly. This adjustment can be optimized in the field by observing the combined effect of "set flow" and "cut-off delay". For example, a well with a low gas content stream, the setting may be as low as one second. In that case, the flow rate through the flow meter must remain below the flow rate cut-off set point for a continuous period of one second as defined by this setting for the motor cut-off switch to be activated. If the flow rate signal fluctuates above and below the "set flow" rate the time delay threshold will not have been exceeded because it is reset each time the flow rate exceeds the cut-off set point.

Also shown on the outer circuit board 52 is a start-up timer switch mechanism 72 having a plurality of switches 74 which are each disposed for "on" or "off" positioning. The switches are arranged in approximate 10 minute increments of time with the upper switch setting a start-up time period of 10 minutes, the second switch 20 minutes, the third switch 30 minutes, and so on, for a maximum of 60 minutes when the bottom switch is moved to its "on" position. As shown in FIG. 3A, the start-up delay time period is set at 50 minutes since the 50 minute switch is at its "on" position while the remaining switches are at their "off" positions. The start-up delay timer sets the time interval for the activation of the motor cut-off logic. Only one of the switches will be in the "on" position at any point in time. If none of the switches are in the "on" position, the start-up interval defaults to the bottom switch and sets the time period for start-up delay to about 60 minutes. If more than one switch is in the "on" position, then the start-up interval takes the value of the lowest switch in the "on" position. This time delay setting prevents cut-off logic activation until the pump has filled the meter line. The length of time interval should be field estimated based on the depth of the well, pump capacity, etc. which determine the time it takes for the liquid to fill the meter line.

At the center of the outer circuit board 52 is provided a start button 76 which starts the motor and initializes the circuit "start-up" timer. For initiation of the start-up timer, the start button is depressed for approximately one second before release. The logic configuration may also be designed so that the start button may be pressed and released instantaneously to initialize the start-up timer. If at any time during normal operation the "start" button is pressed, the timed delay motor cut-off logic will be initialized and the "start-up timer" delay is reset in accordance with the switch setting in the "start-up" timer.

The outer circuit board 52 is also provided with three light emitting diodes (LEDs) which are indicated at 78, 80 and 82 and which respectively indicate conditions of the pump, flow through the flow sensor and the condition of the start-up delay circuit. The LEDs 78, 80 and 82 are each bi-color (red and green) LEDs which show no color in the respective "off" positions thereof Thus, if all of the LEDs are off, there is provided an indication that there is no power to the outer circuit board or all of the LEDs are damaged. If only one or two LEDs are off, there is provided an indication that the circuit board is operative but the LEDs in question may be damaged.

Pump LED:—When the pump LED is showing green, the pump circuit is on and the pump motor is operating. Conversely, when the pump LED is showing red, the pump motor is off, and pump stoppage was activated by the time delay motor cut-off logic. Before reactivating the circuit, service personnel should ascertain the cause of the pump shut-off because indication has been provided to the circuitry that the pump flow condition was abnormally low and remained at his abnormally low condition for a time period equaling or exceeding the preset time period for motor shut-off. In other words, the preset values of the potentiometer circuits 64 and 68 have been exceeded either because of a mechanical problem with the downhole pump or a temporary problem with the well which influences the flow of well fluid into the well. Obviously, if the problem is of mechanical nature, involving the pump, then service personnel will determine if appropriate adjustments can be made to resume normal pumping.

The outer circuit board illustrations of FIGS. 3A–3E represent five differing circuit conditions. The conditions shown in FIG. 3A is a normal condition indicating pump operation and flow through the downhole flow transducer assuming that LED 78 is showing either green and LED 80 is showing either red or green. When the start-up LED is showing green the start-up circuit is energized but the initial start-up time delay has not expired and the flow responsive time delay is not operative. If LED 80 is showing red, then a pump abnormality exists which is indicated by low flow in the flow line 28. In this case, pump shut-off will occur automatically when the adjust settings of the potentiometers 64 and 68 have been exceeded.

FIG. 3B shows all of the LEDs 78, 80 and 82 are green. This would normally indicate that the time delay motor cut-off logic is inoperative, but the initial start-up time period has not expired. The green LEDs also indicate that flow in the flow line is above the set point for pump cut-off and that the pump is running. In this position, the adjustment element 66 of the potentiometer 64 will be adjusted to provide appropriate flow rate data, i.e. 2.00 volts in the display panel 62 corresponds to a specific flow rate which is optimized for the well, based on well equipment, meter size, meter selection, gas content of the well fluid, meter sizing parameters, secondary instruments of the meter, etc. . .

Figure 3C:
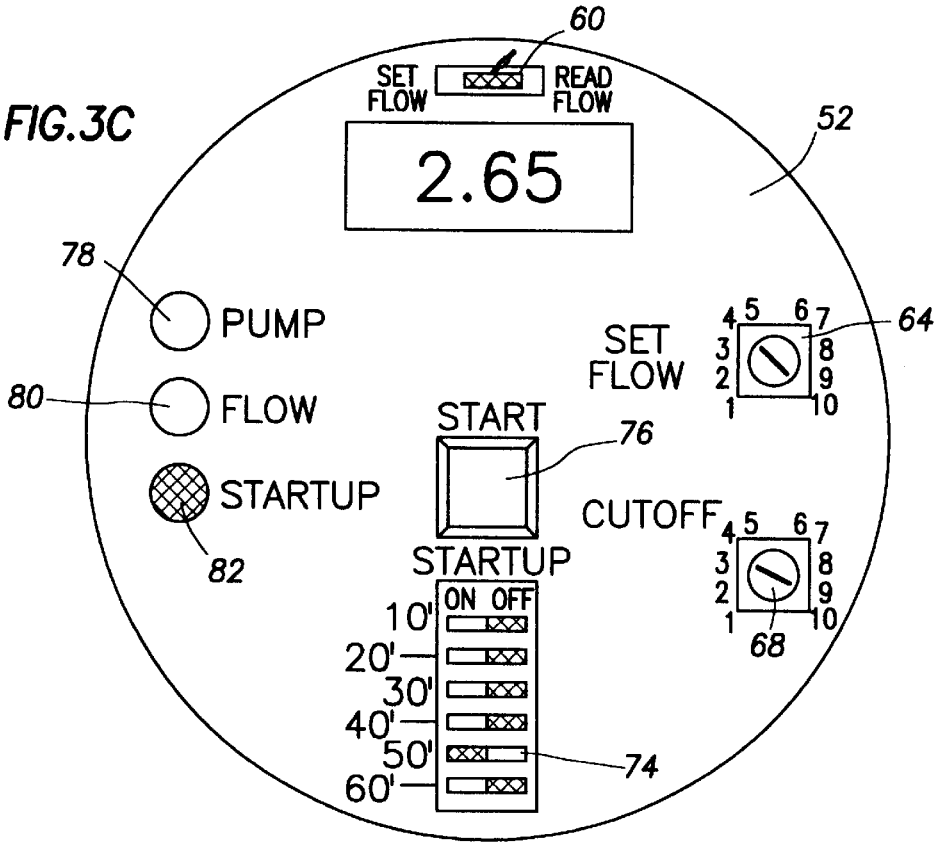

In FIG. 3C, the outer circuit board 52 is shown with the pump and flow LEDs 78 and 80 green and the start-up LED 82 is red, indicating that the initial time delay period for start-up has expired and the time delay circuit is operational. There is also provided an indication that the flow is above the cut-off set point and the pump is operating.

Figure 3D:
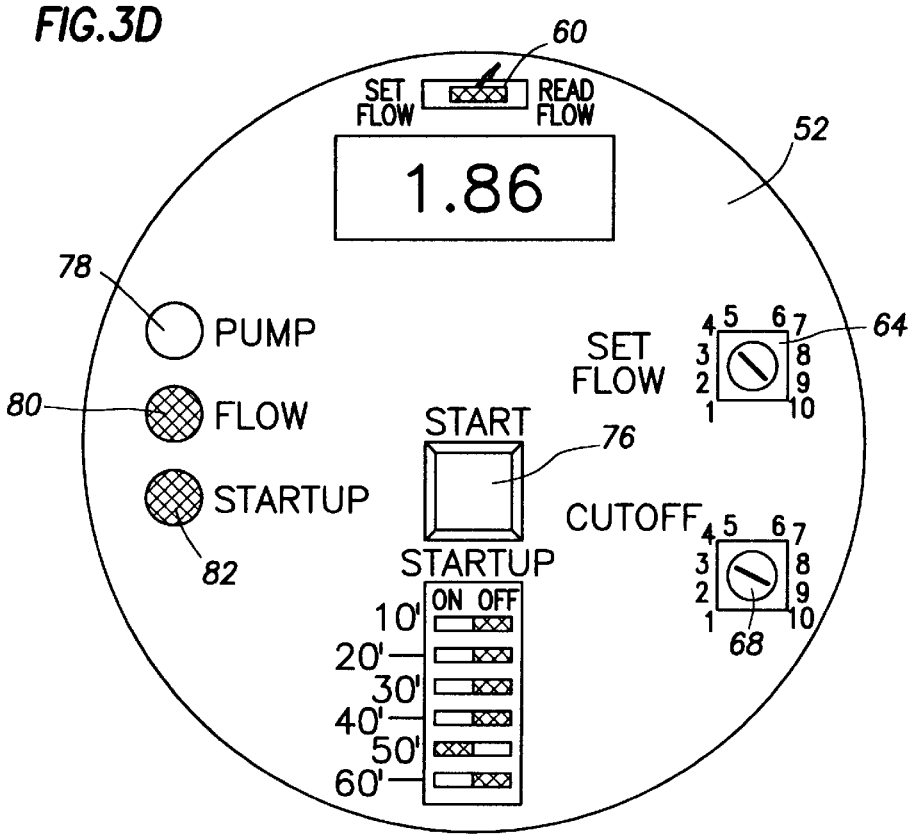

It should be noted with respect to FIG. 3D that the momentary toggle switch 60 is in its "read flow" position so that the actual flow condition through the flow meter is 1.86. Since this actual flow condition is below the "set flow" limits set by the potentiometer 64 and for a period below the preset limits established by the cut-off delay potentiometer 68 then the downhole pump is not de-energized by the time delay motor cut-off logic. In this case the "flow" LED 80 will be showing red because the condition of pump flow is below the preset limits established by the "set flow" potentiometer 64. The pump LED 78 is green, "indicating" that, although flow is below the set flow rate, the time set by the cut-off switch 68 is not exceeded. Also in this condition, the start-up circuit LED 82 is red, indicating the initial start delay, as set by switch 72, has been exceeded and the pump cutoff circuit logic has been activated. The display exhibited by FIG. 3D indicate the possibility that a condition of abnormally low flow exists through the downhole meter, indicating a pump or motor problem or indicating that more than the usual quantity of gas is passing through the meter.

Figure 3E:
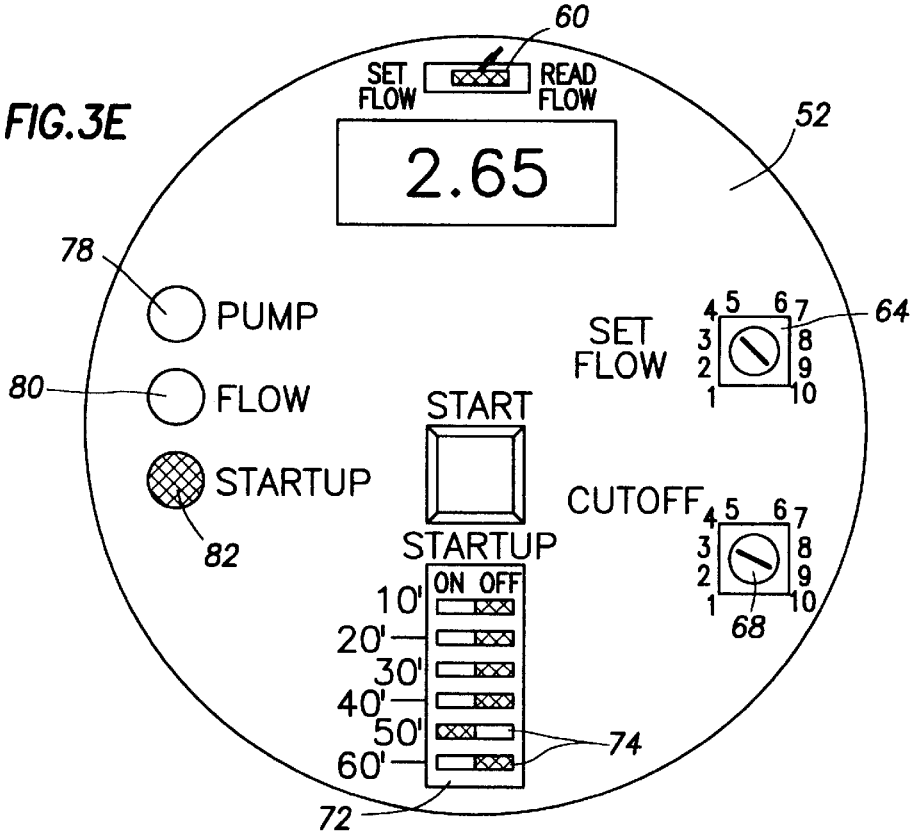

As represented by FIG. 3E, the LEDs 78, 80 and 82 are each shown to be in their normal operating condition while the momentary toggle switch 60 is in its "read flow" position. In this condition of the outer board circuitry 52, the outer board circuitry is operating with the flow rate above cut off condition set by switch 64. The circuit is now activated as initial start up delay has been exceeded which is indicated by red start up LED 82. When all LED's are red there is provided an indication that the pump circuit is energized and the pump has been deactivated because the flow rate remained below the "set flow" condition over a period exceeding the switch setting 68.

Flow: If the LED 80 is showing green, the flow rate through the downhole flow meter is above the cut-off rate set point that is established by the adjustment position of the potentiometer 68. If the flow LED is showing red, then the flow rate through the downhole flow meter is below the cut-off flow rate set point. If the LED 80 is flickering red and green, then there is provided an indication that the flow through the flow meter is fluctuating above and below the cut-off flow rate set point. In this case, the pump will be permitted to continue its normal operation until such time as the cut-off delay period that is established by the setting of potentiometer 68 is exceeded. The time delay motor cut-off logic will operate to de-energized the pump motor only under circumstances where the flow rate through the flow meter remains below the cut-off flow rate set point for a period exceeding the time delay cut-off period that is pre-set by the cut-off potentiometer 68.

Start-up: When the LED for the start up circuit is showing green, the circuit is in operation but the initial "start-up" delay period that is established by the "on" position of one the start-up switches 74 has not expired. In this case the operator should check the "pump" LED to confirm that the pump is in operation. If the "pump" LED is green, the circuit will be active after the "start-up" delay has expired. If the "start-up" LED is green, but the "pump" LED is red, the motor is not running and the motor was deactivated by the time delay motor cut-off logic. The circuit must then be reset with the "start" button by pressing the button and holding it in its depressed condition for a period of about one second so that the start-up holding circuit will remain active when the start button is released. As a caution, if the "pump" LED is red, the cause of the deactivation must be ascertained before resetting the circuit.

If the start up LED is showing red, the "start-up" delay period has expired and the time delay motor cut-off logic is active and immediately responsive to conditions of flow through the downhole flow meter.

As a general caution, after a power failure to the time delay motor cut-off board, the cut-off logic will activate upon power resumption, and the "start-up time" will be initiated in accordance with the setting of the switches 74 of the start-up timer 72.

In view of the foregoing, it is evident that the present invention is one well adapted to attain all of the objects and features that are hereinabove set forth, together with other objects and features which are inherent in the apparatus disclosed herein.

As will be readily apparent to those skilled in the art, the present invention may be produced in other specific forms without departing from its spirit, scope and essential characteristics. The present embodiment is therefore to be considered as illustrative and not restrictive, the scope of this invention being defined by the claims rather than by the foregoing description, and all changes which come within the meaning and range of equivalence of the claims are therefore intended to be embraced therein.

What is claimed is:

1. An automatically controlled fluid flow responsive method for achieving de-energization of an electric motor of a downhole pump being connected to a production tubing string of a well when the pump discharge flow from the downhole pump becomes abnormally low, comprising:

(a) establishing a selective pump cut-off flow rate condition representing a predetermined minimum rate of discharge flow from the downhole pump by an adjustable cut-off set level circuit having a signal output range and being adjustable to provide a selective signal output within said signal output range;

(b) comparing s aid s elective signal output of said cut-off set level circuit with the flow meter signal;

(c) receiving a flow signal representing the actual pump discharge flow of fluid from the downhole pump;

(d) establishing a selected electronically controlled time delay period being initiated when said flow rate becomes less than said selective pump cut-off flow rate condition;

(e) electronically interrupting electrical power supply to said rotary electric motor when the pump discharge flow rate remains less than said selective cut-off flow rate for the duration of said electronically controlled time delay period; and (f) adjusting said adjustable cut-off set level circuit to a selected delay value within said time delay/voltage range representing the maximum time period that the pump motor will be permitted to operate in a continuous low flow condition before electronically interrupting electrical power supply to said rotary electric motor.

2. The automatically controlled fluid flow responsive method of claim 1, wherein a time delay motor cut-off circuit is provided having a "set-flow" circuit for adjustment thereof, said method comprising:

(a) de-energizing said time delay motor cut-off circuit;

(b) adjusting said set-flow circuit to a "set-flow" circuit voltage representing a predetermined discharge flow of said downhole pump; and (c) re-energizing said "set-flow" circuit.

3. The automatically controlled fluid flow responsive method of claim 2, wherein a digital voltmeter is provided in said time delay motor cut-off circuit and has a voltmeter display, said step of adjusting comprising:

adjusting said set-flow circuit to a desired value on said voltmeter display representing a desired minimum set voltage.

4. The automatically controlled fluid flow responsive method of claim 1, wherein said time delay motor cut-off logic has therein a start-up delay circuit having a plurality of selective timing increments and, after pump motor start-up, maintaining said time delay motor cut-off logic inoperative until expiration of a selected start-up timing period, said method comprising:

(a) actuating said time delay motor cut-off logic for starting operation of said pump motor; and (b) upon expiration of said selected start-up timing period, actuating said time delay motor cut-off responsive to a condition of pump discharge flow below a pre-set limit and which remains below said pre-set limit continuously for a pre-set minimum time period.

5. An automatically controlled fluid flow responsive method for achieving de-energization of an electric motor of a downhole pump being connected to a production tubing string of a well when flow from the downhole pump becomes abnormally low, wherein a time delay motor cut-off logic is provided having a cut-off timing circuit into which is connected a cut-off delay circuit being adjustable for adjustment thereof within a time delay/voltage range, said method comprising:

(a) establishing a selective pump cut-off flow rate representing a predetermined minimum rate of discharge flow from the downhole pump;

(b) receiving a flow signal representing the actual rate of discharge flow from the downhole pump;

(c) establishing a selected electronically controlled time delay period being initiated when the actual rate of discharge flow from the downhole pump becomes less than said selective pump cut-off flow rate;

(d) electronically interrupting electrical power supply to said rotary electric motor when said rate of discharge flow remains less than said selective cut-off flow rate for the duration of said electronically controlled time delay period; and (e) adjusting said cut-off delay circuit to a selected delay value within said time delay/voltage range representing the maximum time period that the pump motor will be permitted to operate in a continuous low flow condition before de-energization of the pump motor by said time delay motor cut-off logic.

6. The automatically controlled fluid flow responsive method of claim 5, wherein a digital voltmeter is provided in said time delay motor cut-off circuit and has a voltmeter display, said step of adjusting said time delay circuit comprising:

adjusting said set-flow circuit to achieve a desired value on said voltmeter display representing a selected time related voltage within said time/voltage range thereof.

7. A pump discharge flow responsive electronic time delay motor cut-off control system for de-energizing the motor of a downhole pump in the event the discharge flow from the downhole pump becomes abnormally low and remains abnormally low for a predetermined period of time, comprising:

(a) a flow transducer sensing the discharge flow of the downhole pump and providing a flow transducer voltage representing the discharge flow from the downhole pump;

(b) an adjustable "set-flow" circuit providing a set-flow voltage range and being adjustable to provide a set-flow voltage output within said set-flow voltage range;

(c) logic circuitry for comparing said flow transducer voltage and said set-flow voltage and providing a flow related logic output;

(d) a cut-off delay circuit receiving said flow related logic output and having a maximum delay timing sequence range, said cut-off delay circuit being initiated for timing as long as said flow related logic output represents a rate of pump discharge flow below that set by said adjustable "set-flow" circuit and being terminated when said logic output represents a rate of pump discharge above that set by said adjustable "set-flow" circuit and providing a motor cut-off signal for de-energization of said motor at the completion of said delay timing sequence, said cut-off delay circuit being reinitiated when said flow related logic output is above said set flow voltage; and (e) an adjustable cut-off delay circuit being provided in said cut-off delay circuit and being selectively positionable for adjustment of the duration of said delay timing sequence.

8. The pump discharge flow responsive electronic time delay motor cut-off control system of claim 7, wherein:

said "set-flow" circuit being adjustable and defining said set-flow voltage range and being positionable for adjustment of said set-flow voltage within said set-flow voltage range.

9. The pump discharge flow responsive electronic time delay motor cut-off control system of claim 7, wherein:

said logic circuitry being flow related voltage comparator circuitry providing flow related logic and providing a flow related logic output only when said flow meter voltage is less than said set-flow voltage output.

10. The pump discharge flow responsive electronic time delay motor cut-off control system of claim 7, wherein:

(a) visual display circuitry being provided in said electronic time delay motor cut-off control circuit; and (b) a first LED circuit being provided in said visual display circuitry and showing a color representing pump operation, a second color representing pump motor deenergization and no color representing inoperative circuitry or damaged LED.

11. The pump discharge flow responsive electronic time delay motor cut-off control system of claim 10, wherein:

a second LED circuit being provided in said visual display circuitry and showing a color representing discharge flow from said pump at a rate of flow above said set-flow rate, a second color representing discharge flow from said pump at a rate of flow below said set-flow rate and no color representing inoperative circuitry or damaged LED.

12. The pump discharge flow responsive electronic time delay motor cut-off control system of claim 11, wherein:

a third LED circuit being provided in said visual display circuitry and showing a color representing operation of said start-up delay circuit and that the start-up delay period has not expired, a second color representing expiration of said start-up delay period and the start-up delay circuit is active and no color representing inoperative start-up delay circuitry or damaged LED.

13. An electronic flow rate responsive time delay motor cut-off system for a rotary downhole pump in a well for production of well fluid being driven by a rotary electric pump motor having a motor circuit including a motor switch for energizing and de-energizing the motor circuit, comprising:

(a) a flow transducer being located to sense the rate of discharge flow of said rotary downhole pump and providing electronic flow rate signals indicating the rate of discharge flow from said downhole pump;

(b) control circuitry having controlling connection with said motor switch for turning said pump switch "on" and "off" for controlling the supply of electrical power to said rotary electric motor;

(c) an electronic "set flow" circuit being connected to receive said electronic flow rate signals and being adjustable to provide a low flow signal output when said electronic flow rate signals indicate pump discharge flow at or below a set flow rate; represented by the setting of said electronic "set-flow" circuit and (d) an adjustable cut-off timer circuit being connected to receive said low flow signal output of said electronic "set-flow" circuit and being adjustable to establish a selected time period being initiated by said low flow signal output and being terminated by absence of said low flow signal output, said adjustable cut-off timer circuit being connected to the motor switch of said rotary electric motor and turning said motor switch off for de-energization of said rotary electric motor upon completion of a selected time period during which said low flow signal output being provided showing a continuous low flow condition of rotary downhole pump discharge throughout the entirety of said selected time period.

14. The electronic flow rate responsive time delay motor cut-off system of claim 13, wherein:

a start-up delay circuit being provided in said control circuitry and being adjustable for establishing a selected start-up time period, said start-up delay circuit rendering said cut-off timer circuit inoperative during said start-up time period and thus permitting motor and pump operation that is not influenced by said time delay motor cut-off system during said start-up time period.

15. The electronic flow rate responsive time delay motor cut-off system of claim 13, wherein:

said "set flow" circuit, said cut-off delay circuit and said pump motor circuit each having at least one light emitting diode therein to provide visual recognition of the operational characteristics thereof.

* * * * *